United States Patent [19]

Shroff et al.

[11] 4,393,328

[45] Jul. 12, 1983

[54] HOT CATHODE, ITS PRODUCTION PROCESS AND ELECTRON TUBE INCORPORATING SUCH A CATHODE

[75] Inventors: Arvind Shroff; Pierre Palluel, both of Paris, France

[73] Assignee: Thomson-CSF, Paris, France

[21] Appl. No.: 204,176

[22] Filed: Nov. 5, 1980

[30] Foreign Application Priority Data

Nov. 9, 1979 [FR] France ..... 79 27715

[51] Int. Cl.[3] ..... H01J 1/14

[52] U.S. Cl. ..... 313/346 R; 313/346 DC; 313/348

[58] Field of Search ..... 313/346 E, 346 DC, 348

[56] References Cited

U.S. PATENT DOCUMENTS 2,581,408 1/1952 Hamilton ..... 313/346 R
2,864,028 12/1958 Coppola ..... 313/346 R
2,929,133 3/1960 Hughes ..... 313/346 DC
4,101,800 7/1978 Thomas ..... 313/346 DC
4,302,702 11/1981 Montgaillard et al. ..... 313/348

FOREIGN PATENT DOCUMENTS 4424 6/1979 European Pat. Off. .

OTHER PUBLICATIONS

"Reference Data for Engineers", 4th Edition, p. 43.

*Primary Examiner*—Harold A. Dixon
*Attorney, Agent, or Firm*—Roland Plottel

[57] ABSTRACT

The hot cathode, according to the invention, is constituted by a fritted matrix 1 and a heating filament 4, said matrix being formed from a powder mixture 2 of tungsten and another high work function refractory metal and covered with a high work function refractory metal film 3. FIG. 3.

4 Claims, 3 Drawing Figures

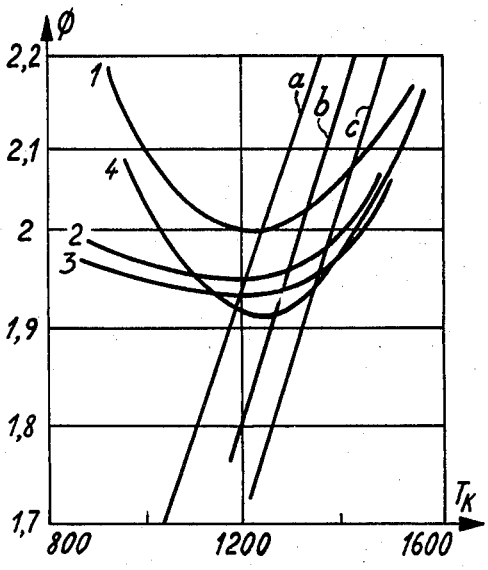
FIG. 1
FIG. 2
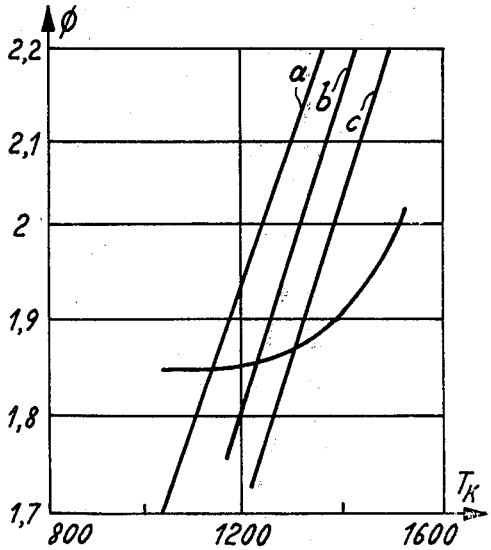
FIG. 3
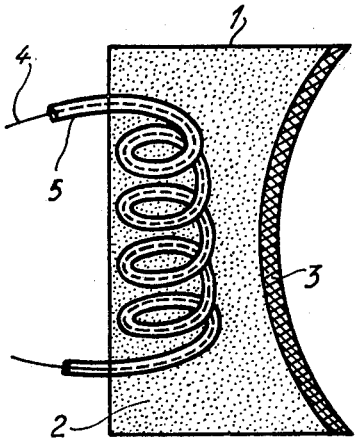

HOT CATHODE, ITS PRODUCTION PROCESS AND ELECTRON TUBE INCORPORATING SUCH A CATHODE

BACKGROUND OF THE INVENTION

The present invention relates to a hot cathode and its production process. Such cathodes are used in electron tubes, tubes with localized parameters such as triodes and tetrodes or tubes with distributed parameters such as klystrons and magnetrons used at ultra-high frequencies. The invention also relates to such electron tubes.

The power developed by electron tubes at ultra-high frequencies is particularly limited by the current density produced by the cathode.

For many years, hot cathodes have been known which comprise a tungsten matrix impregnated with barium and calcium aluminates in variable proportions. The performances of these cathodes are approximately 1 to 3 A/cm$^2$, depending on the aluminate compositions used and for temperatures between 1000° and 1035° C. The prior art has proposed various solutions for improving the performances of these cathodes. One of the proposed solutions consists of the surface deposition of a high work output refractory metal such as iridium, osmium, ruthenium or rhenium. The current density gain for the same temperature is approximately a factor of 3. The temperature gain for the same current density is approximately 80° C.

Instead of depositing a film of a refractory metal with a high work function on the cathode surface a more recent solution consists of mixing tungsten powder with said metal in proportions varying between 10 and 80% and then impregnating the cathode. The electron emission characteristics of these cathodes are 2 to 5 times higher than those of cathodes of tungsten only, depending on the metal used in the mixture. Particular reference should be made in this connection to French Pat. No. 77/18822 published as No. 2,356,263.

It has been possible to compare the performances of these three types of cathodes, i.e. impregnated only, impregnated and covered and mixed impregnated cathodes by means of an experimental study based on a group of curves giving the work function as a function of the temperature for different cathodes.

The curves are in the form of garlands and have a minimum for a temperature close to the optimum temperature corresponding to the optimum covering of the cathode. There is found to be a reduction in the work function of the cathode at temperatures lower than the optimum temperature for curves corresponding to covered impregnated cathodes. There is also a reduction of the minimum of the curve in the case of mixed impregnated cathodes.

BRIEF SUMMARY OF THE INVENTION

On the basis of these findings, the applicant has carried out tests in connection with the construction of a covered, mixed impregnated cathode. The curve giving the work function of the cathode as a function of the temperature combines the two effects present in the case of mixed impregnated cathodes and covered impregnated cathodes considered individually. In other words, there is simultaneously a reduction of the minimum of the curve and a reduction of the work function at temperatures below the optimum temperature. The performance figures of such a cathode are 10 to 20 A/cm$^2$ at a temperature between 1300° and 1350° K.

BRIEF DESCRIPTION OF THE DRAWINGS

The invention is described in greater detail hereinafter relative to non-limitative embodiments and the attached drawings, wherein show:

FIG. 1 the work function diagram ($\phi$) in eV as a function of the absolute operating temperature $(T)_K$ for different types of cathode according to the prior art.

FIG. 2 the work function diagram ($\phi$) as a function of the operating temperature $(T)_K$ for a cathode according to the invention.

FIG. 3 the diagram of a cathode according to the invention.

DETAILED DESCRIPTION OF THE PREFERRED EMBODIMENTS

FIG. 1 shows a group of curves giving the work function $\phi$ in eV as a function of the operating temperature $T_K$ for different types of cathodes according to the prior art. Curve 1 relates to a cathode formed from a tungsten matrix and impregnated with barium and calcium aluminates. Curves 2 and 3 relate to cathodes formed from a tungsten matrix impregnated with barium and calcium aluminates and covered with a film of a refractory material with a high work function such as iridium (curve 2), osmium (curve 3), ruthenium or rhenium (not shown curves). Curve 4 relates to a cathode formed by a mixed matrix composed of a mixture of tungsten powders and a refractory metal with a high work function, such as one of those referred to hereinbefore and impregnated with a barium compound.

These curves are in the form of a garland with a minimum in the vicinity of the optimum temperature which corresponds to the optimum covering of the cathode. The optimum temperature is approximately 1250° K. On either side of this temperature, there is a rapid rise in the work function in the case of the impregnated cathodes (curve 1). Beyond 1250° K., the covering level rapidly decreases due to the unbalance between the evaporation rate and the barium supply rate.

Below 1250° K., the barium recombines with the underlying aluminate to give once again a stable product and consequently there is no longer an optimum covering.

In the case of curves 2 and 3 (covered, impregnated cathodes) there is a reduction of the curve at low temperature. At high temperatures, the curves have the same configuration as that corresponding to the impregnated cathodes. This is due to the fact that the film covering the cathode makes the surface equilibrium most stable at low temperature.

Curve 4 (mixed, impregnated cathodes) has the same variations as in the case of curve 1 (impregnated cathode), but the minimum of the curve is at a lower level. The electrical transmission characteristics of these cathodes are 2 to 5 times higher than those of cathodes which are only impregnated, as a function of the metal used in the mixture.

On increasing the proportion of the high work function refractory metal mixed with the tungsten powder to beyond 50%, the fieldless current density dropped. The maximum is 20% in the case of iridium and 50% in the case of osmium.

The temperature gain for the same current density is approximately 80%, as is shown by the intersections of curves 1, 2, 3 and 4 with straight lines (a), (b) and (c) at constant current density:

1 A/cm$^2$ for straight line (a)

5 A/cm$^2$ for straight line (b)

10 A/cm$^2$ for straight line (c).

FIG. 2 shows the curve giving the work function in eV as a function of the operating temperature $T_K$ for a cathode according to the invention, i.e. a cathode formed from a matrix impregnated with a barium compound and formed from a mixture of powder of two metals, tungsten and a high work function refractory metal such as osmium, iridium, ruthenium or rhenium and covered with a film of one of the metals referred to hereinbefore.

The curved obtained has a minimum below those of the curves of FIG. 1. The curve is flat at temperatures below the optimum temperature.

For a cathode formed from a matrix (W+x ) in respective proportions between 30 and 70%, x being a high work function refractory metal among those referred to hereinbefore, and covered with a film x of thickness between 5000 and 10,000 Å performance levels between 10 and 20 A/cm$^2$ are obtained at a temperature between 1300° and 1350° K.

FIG. 3 is an exemplified, diagrammatic, cross-sectional view of a cathode according to the invention, although such a drawing is unable to show that the matrix 1 comprises a mixture of two powders, namely tungsten and another high work function refractory metal. It is assumed that the portion covered with dots and designated by the reference numeral 2 is formed from such a mixture. Matrix 1 is covered with a high work function refractory metal film 3.

It should be noted that the thickness of this film is approximately 10,000 Å and that the scale is not shown on the drawing. A filament 4 having an insulating film 5 is incorporated into matrix 1.

According to a préparation mode for a cathode according to the invention, equal weights of tungsten powder and another high work function refractory metal having a relatively close grain size distribution are mixed without using a binder. The thus formed mixture is pressed to between 7 and 10 t/cm$^2$ and then prefritted under hydrogen at a brightness or radiation temperature between 1100° and 1300° $C_B$ for approximately 12 h. The thus obtained samples are fritted in vacuo at a brightness or radiation temperature between 1850° and 1900° CB. They are then impregnated with barium and calcium aluminates. The excess aluminate on the surface is removed chemically by dissolving in a mineral or organic acid. The thin film is then deposited by cathodic sputtering or evaporation.

What is claimed is:

1. A process for producing a cathode formed from a matrix of a fritted powder metal impregnated with a barium compound, and a heating filament associated with said matrix, wherein the matrix is formed from a mixture of two metals, tungsten and another high work function refractory metal, and wherein the matrix is covered with a high work function refractory metal film, comprising the following successive stages:

(a) mixing powders of tungsten and another high work function refractory metal (b) pressing the mixture between 7 and 10 t/cm$^2$ (c) prefritting under hydrogen at between 1100° and 1300° CB for approximately 12 h (d) fritting in vacuo at a temperature between 1850 and (e) impregnation with calcium and barium aluminates (f) elimination of the excess aluminate present on the surface by a chemical process (g) deposition of the high work function refractory metal film.

2. A process according to claim 1 wherein said high work function refractory metal is selected from the group comprising iridium, osmium, ruthenium, and rhenium.

3. A process according to claim 1 wherein the deposition is by cathodic sputtering.

4. A process according to claim 1 wherein the deposition is by evaporation.

* * * * *